US009719309B2

(12) United States Patent
Brower

(10) Patent No.: US 9,719,309 B2
(45) Date of Patent: Aug. 1, 2017

(54) INSTRUMENTED STRAKES AND FAIRINGS FOR SUBSEA RISER AND PIPELINE MONITORING

(76) Inventor: David V. Brower, Houston, TX (US)

( * ) Notice: Subject to any disclaimer, the term of this patent is extended or adjusted under 35 U.S.C. 154(b) by 216 days.

(21) Appl. No.: 13/456,481

(22) Filed: Apr. 26, 2012

(65) Prior Publication Data

US 2013/0287501 A1 Oct. 31, 2013

(51) Int. Cl.
*E21B 17/01* (2006.01)
*B63B 21/50* (2006.01)

(52) U.S. Cl.
CPC ..... *E21B 17/01* (2013.01); *B63B 2021/504* (2013.01)

(58) Field of Classification Search
CPC ... G01F 1/3263; G01F 1/7086; B63B 21/663; G01N 2291/02836; E21B 47/123; E21B 47/0006; G01V 8/16
USPC ..... 405/211, 216; 73/1.79, 1.82, 570, 781, 73/861.18
See application file for complete search history.

(56) References Cited

U.S. PATENT DOCUMENTS 4,033,279 A * 7/1977 Stiles ..... 114/243
4,654,520 A * 3/1987 Griffiths ..... 250/227.14
5,026,141 A * 6/1991 Griffiths ..... 385/13
5,525,796 A * 6/1996 Haake ..... 250/227.15
5,649,035 A * 7/1997 Zimmerman et al. ..... 385/13
6,271,766 B1 * 8/2001 Didden et al. ..... 340/853.1
6,913,079 B2 * 7/2005 Tubel ..... 166/250.01
6,959,604 B2 * 11/2005 Bryant et al. ..... 73/705
7,058,549 B2 * 6/2006 Gysling et al. ..... 702/189
7,194,913 B2 * 3/2007 Morrison et al. ..... 73/800
7,277,162 B2 * 10/2007 Williams ..... 356/32
7,398,697 B2 * 7/2008 Allen et al. ..... 73/800
7,461,561 B2 * 12/2008 Morrison et al. ..... 73/800
7,591,188 B2 * 9/2009 Allen et al. ..... 73/825
7,721,611 B2 * 5/2010 Salama ..... 73/862.627
8,074,720 B2 * 12/2011 Radi ..... 166/350
8,381,599 B2 * 2/2013 Bosselmann ..... 73/861.18
8,540,030 B2 * 9/2013 Radi ..... 166/350
2004/0035216 A1 * 2/2004 Morrison et al. ..... 73/800
2004/0125698 A1 * 7/2004 George et al. ..... 367/20
2004/0144182 A1 * 7/2004 Gysling et al. ..... 73/861.42
2004/0255695 A1 * 12/2004 Gysling et al. ..... 73/862
2006/0230839 A1 * 10/2006 Morrison et al. ..... 73/800
2007/0151365 A1 * 7/2007 Gysling et al. ..... 73/861.42
2008/0128138 A1 * 6/2008 Radi ..... 166/350
2011/0107846 A1 * 5/2011 Bosselmann ..... 73/861.18

* cited by examiner

*Primary Examiner* — Tara M. Pinnock

(57) ABSTRACT

A vortex induced vibration suppression system for use on a subsea riser system having either a stake or fairing component includes at least one fiber optic sensor mounted on the component. The fiber optic sensor associated with the riser includes at least one sensor for producing a sensor signal. The system may include a plurality of sensors and the plurality of signals produced thereby are combined at a multiplexer for generating a single, composite sensor signal. The signal may be monitored in real time or near real time for observing and monitoring the reaction of the subsea riser to conditions inducing vibration.

3 Claims, 3 Drawing Sheets

INSTRUMENTED STRAKES AND FAIRINGS FOR SUBSEA RISER AND PIPELINE MONITORING

BACKGROUND

Field of the Invention

The invention is generally related to an apparatus and method for measuring structural loading response in risers and pipelines in deepwater oil and gas applications, and is specifically directed to instrumentation and methods for measuring the structural response of the riser by utilizing instrumentation in direct communication with the strakes and fairings attached to the riser.

Discussion of the Prior Art

Strakes and fairings are typically installed on risers in deepwater applications to help suppress vortex induced vibration that occurs from ocean current motion. The vibration can be significant enough to cause rapid fatigue that can lead to early failure of the riser. This phenomenon affects a vast array of structures, particularly in offshore locations, and is due primarily to ocean current interacting with the riser. Other subsea structures may be affected to current loading, such as tendon legs and mooring lines.

Vortex induced vibration (VIV) of offshore structure originates when fluid (either gas as in wind, or liquid as in seawater, for example) passes a bluff body and causes low pressure eddys or vortices to form downstream of the body. The vortices are shed periodically, at frequencies that are fluid velocity dependent. Typically, vortex shedding induces loading on the body normal to the direction of current flow. For example, a riser is generally vertical and the VIV is caused by generally horizontal sea currents. This will create amplitudes of oscillation, often severe enough to damage the riser components. The oscillation is typically induced when the interaction between the flow and the structure motion causes lock-in, or becomes generally continuous and repetitive. This cyclic motion creating tension and changing curvature initiates fatigue in the structure, at time causing failure.

Marine risers are among the most common structures to be subject to VIV in offshore applications. Specifically, the design of the catenary riser, the top tensioned risers, flexibles and the drilling risers are affected by VIV. Deep water risers, typically steel catenary risers, are particularly susceptible to VIV. These risers tend to have high natural cycles or modes. High currents can excite high modes in these structures. Typically, the higher the mode number results in larger curvature and greater damage to the structure can result.

In the analysis of the effect of VIV on deep water risers it is necessary to consider the effect of both long term and short term extreme event, for example, distinguishing between a strong continuous current and a storm induced surge. Prior art analysis apparatus and methods are deficient because of the inability to obtain useful, timely data along the length of the riser and along the full water column.

Well known programs for predicting VIV damage are SHEAR7, VIVA and VIVANA. These empirical tools are based on modal calculations. While the programs are sufficient for managing the empirical data, it has remained difficult to obtain accurate, timely data relating to the actual cyclic activity of the riser along the water column. The lack of measured data, and the reliance on modeling, has made the calculations estimates, at best. Because of the uncertainty in the data, operators generally require safety factors of between 10 and 20 in the design process.

VIV suppression devices have been developed to reduce the vortices and/or disrupt their formation. Two of the most common suppression elements are helical strakes and fairings. A helical strake consists of a number of fins wound as a helix around the periphery of the riser. The helical strakes shed the vortices into finite cells and length, both shortening and weakening the vortices. Fairings are aerofoil-shaped structures that streamline flow and reduce the VIV by weakening vortices that are shed at that location.

In some cases monitoring systems have been installed on a riser prior to its deployment in deepwater. Such systems typically consist of fiber optic sensors or in some cases accelerometers have been attached in an effort to determine fatigue and structural response.

Fiber optic sensors have provided the most accurate, reliable and efficient attachment methods to manage data. Attachment methods have involved independent sensor stations located at preselected segments along the riser. This novel system prescribes a method that places the sensors directly within the suppression device (for example, a strake or fairing).

It is desirable to obtain accurate, near real-time data relating to the effect of VIV on risers and similar structures in a timely and cost-effective manner in order to promote more efficient and effective riser design, thereby both increasing the safety and also perfecting the design of such structures. By incorporating the sensors within the suppression device, the desired measurements are obtained in a simple and efficient manner to incorporate the valuable data in the monitoring system.

SUMMARY OF THE INVENTION

The subject invention is directed to a system of monitoring sensors that may be installed on the standard strakes or fairings routinely installed as part of the SCR deployment, generating a "VIV suppression device" for each strake or fairing comprised of the strake and sensors or the fairing and sensors. The instrumented stake of this invention is not any more time-consuming or difficult to install than the standard prior art strake. Thus no impact to the very costly SCR installation process occurs.

A component of the instrumented strake is a network of fiber-optic sensors or data logger. The sensors are proven and provide accurate data, and can operate in the extreme environment of deepwater applications. The data acquisition system has the capability to monitor all structural and physical events in or near real time. The resultant analysis can be displayed on the platform control room and has the capability for transmission to offshore locations.

In the preferred embodiment, the bandwidth of the interrogation system is plus or −50 nm around a center wavelength of approximately 1550 nm or alternatively 1310 nm. The optical power of fiber-optic sensor interrogation system is typically greater than 10 dB.

Structurally, a plurality of fiber-optic sensors are multiplexed along a single fiber optic strand. In the preferred embodiment fiber-optic cables consist of single mode fibers.

The instrumented strake of the invention permits the monitoring and determination of a variety of structural and physical properties, including, but not limited to, strain, temperature, pressure, vibration and fatigue. This is accomplished by installing a plurality of fiber-optic sensors directly on the strake and oriented to measure strain in the axial direction, the hoop direction and any other desired orientation. The quantity of axial measurements in a given strake is typically four but can be more or less depending on application. The sensors at each location have the capability of measuring strain in both tension and compression. Where desired, temperature compensation for the sensing devices may be integrated into the instrumented strake. Pressure measurements may be derived from the sensors oriented in the hoop direction. The sensors do not penetrate the riser. Generally, the fiber-optic sensor Bragg grating has a reflectivity of greater than 0.4%.

Issues resolved in order for the system of the subject invention to be practical in the harsh environment of deep-water subsea applications is the placement of the sensors on the strake and the assurance that the mounting system is sufficiently durable to stay in place during the life of the riser, while permitting strain to be accurately monitored and the monitored data transmitted to the surface. It is an important feature of the invention that the data can be collected in or at near real time, and transmitted to a remote monitoring facility, such as, by way of example, the platform or rig control room.

Specifically, the invention describes the apparatus and method for providing strakes and fairing with instrumentation comprising fiber-optic sensors that measure the structural response of the riser. The principle measurements obtained from the instrumented strake or fairing are strain, temperature, pressure, vibration and fatigue. The invention includes components of the sensing device, the associated hardware. software, application methods, data acquisition, installation methods, cabling and connectors, and defines a comprehensive system for equipping strakes, fairings and the like with monitoring systems providing real-time or near real-time data for management of the subsea riser system.

The VIV suppression device for a subsea riser system in accordance with the subject invention includes either a strake or fairing element having at least one fiber optic sensor mounted on the element. The fiber optic sensor includes an output cable for transmission of a sensor signal produced by the fiber optic sensor. A processor is adapted for receiving the sensor signal and producing a processed output signal. Typically, the fiber optic sensor on each VIV suppression device associated with the riser includes a plurality of sensor components forming an array, and wherein each fiber optic sensor component in the array produces a sensor component signal. The multiple array signals may be combined at a multiplexer associated with that specific array for generating a single VIV suppression device sensor signal. Typically the subsea riser system includes a plurality of stakes or fairings (VIV suppression devices). Each fiber optic sensor array produces a unique sensor signal, the subsea riser system further including a multiplexer for combining the unique sensor signals from the fiber optic sensor array for each of the VIV suppression devices, for producing a single cables combined sensor signal to be introduced into the processor. The processed output signal produced by the processor is introduced to a monitor for real time, or near real time monitoring of the processed signal. A database is also associated with the processor for storing the processed signal produced by the processor, for records and for review. Typically, the system will be in communication with a transmission system associated with the processor for transmitting the processed signal to a remote location.

DETAILED DESCRIPTION

Figure 1:
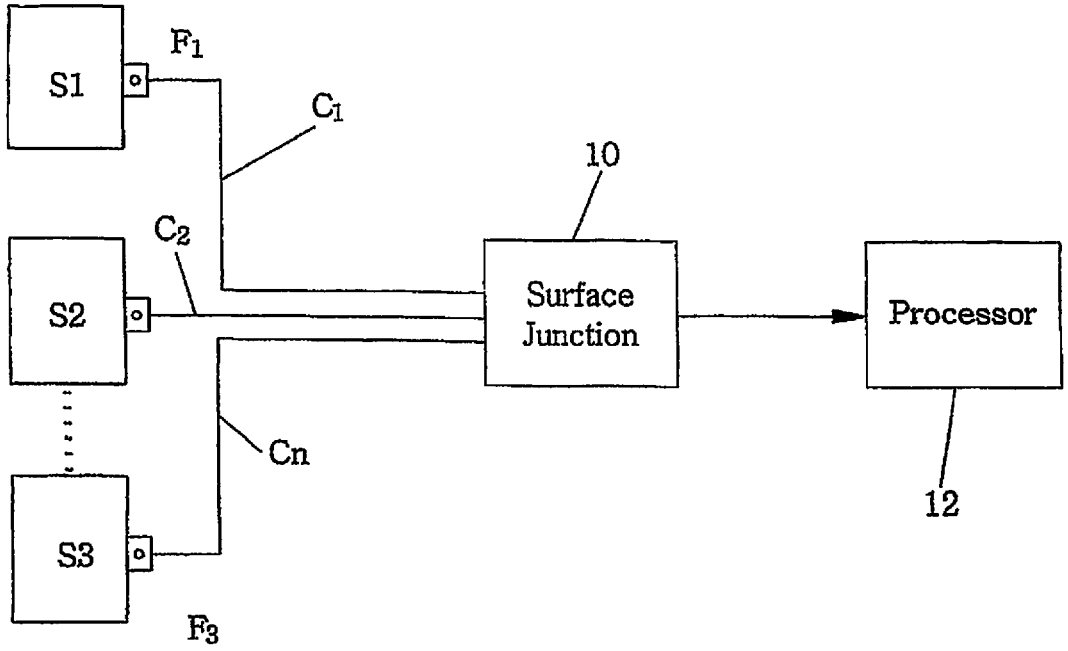
FIG. 1 is a block diagram of the monitoring system of the subject invention.

A system block diagram is shown in FIG. 1. Each riser strake S1-Sn on a riser column includes a fiber optic sensor array, F1-Fn, respectively. Each sensor in the each sensor array produces a sensor output signal on the dedicated fiberoptic cable C1-Cn. The individual sensor signals from each sensor in a sensor array are carried to the surface and combined at a junction system or multiplexer 10. The combined signal is then introduced into a processor 12. As shown, there is a one-to-one relationship between each sensor array and dedicated fiber optic cable for delivering the sensor readings to the surface junction system. The plurality of fiber optic sensor signals are multiplexed along a single fiber optic strand using wavelength division multiplexing and time division multiplexing methods well known to those who are skilled in the art.

The processed signals are then introduced into the processor 12, for archiving in a database 14 or other device, and may be transmitted to a remote location, for management functions, as well. Any developed algorithms may be used to analyze and manage the data produced by sensor system of the subject invention. The analysis by the subject system is more reliable than prior art systems because the data being analyzed is real-time live data, rather than modeling data. This permits accurate assessment of the riser both on a long term basis, as well as during short intervals. For example, long term data may show deterioration over a period of time, whereas short term data may show riser response to storm conditions. This permits the operator to make critical decisions based on real, live data, rather than applying modeling techniques.

In the preferred embodiment, the sensors are oriented to measure the strain on the riser in both the axial direction and the hoop direction. The quantity of axial measurements on each strake is generally four, but this may be altered based on application and preference. The sensors also measure strain in both tension and compression. Temperature compensation for the sensing devices is provided, for correcting the measurements based on the ambient external temperature at the point of each strake or fairing.

Pressure measurements within the riser may be derived from hoop strain measurements, permitting riser pressure to be monitored without penetrating the riser, in a non-invasive system.

In the preferred embodiment each fiber optic sensor has a Bragg grating with a reflectivity value of greater than 0.4%. However, this can be altered based on preference and application.

Also, it should be understood that each fiber optic sensor could include an electric sensor and/or and accelerometer.

The bandwidth of the fiber optic sensor system for a riser system is typically plus or minus 50 nm around a center wavelength of both 1550 nm and 1310 nm. The optical power of the fiber optic sensor system is greater than 10 dβ.

Figure 2:
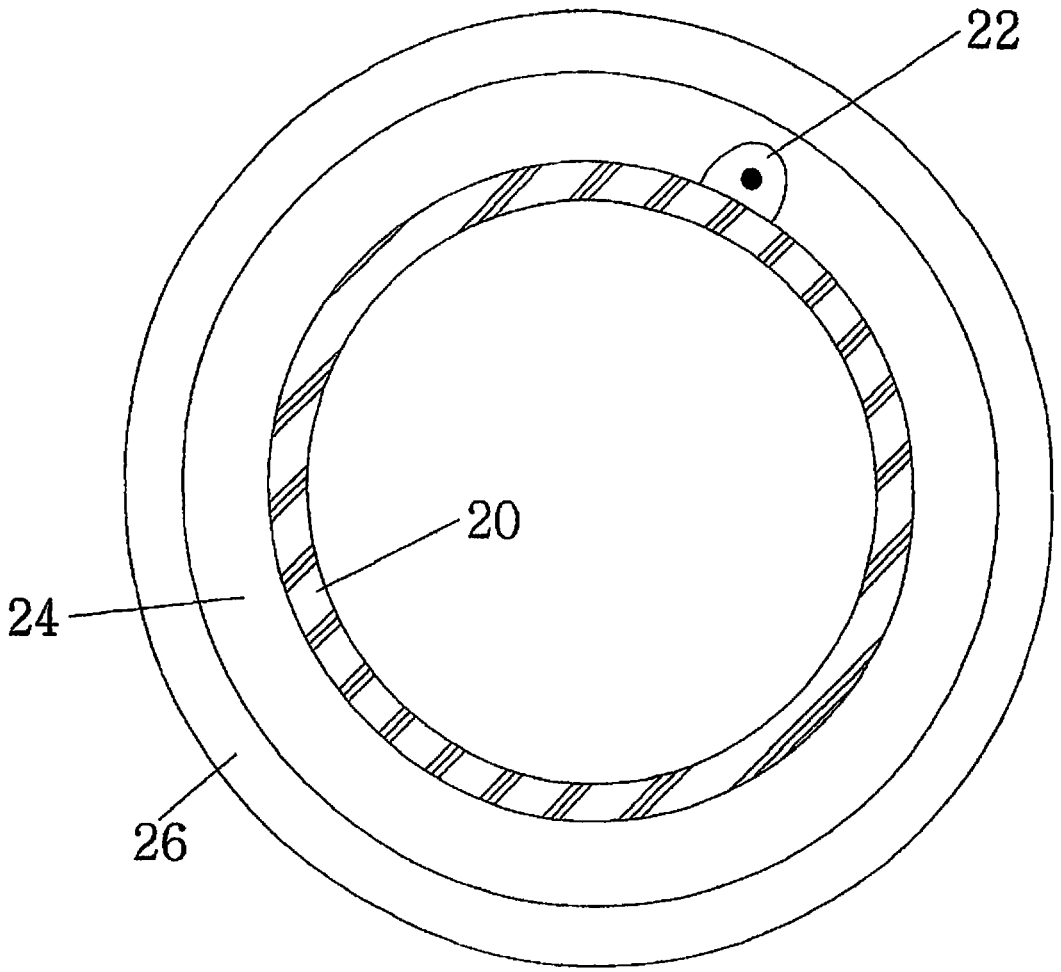
FIG. 2 is a drawing showing mounting of the sensors on a typical strake in a pre-assembly configuration and a post-assembly configuration.

FIG. 2 is a drawing showing the mounting system for placing sensors on at a typical strake 24. In one embodiment each sensor in the sensor array may be mounted on the riser system before the riser is deployed, as each riser component is assembled. In an alternative embodiment each sensor in the sensor array may be installed after the riser in place.

In the first embodiment a typical riser pipe 20, as shown in cross-section, will have a plurality of fiber optic sensors Sm mounted directly on the exterior wall of the riser pipe and secured thereto with a suitable adhesive. In order to protect the fragile sensor Sm, the sensor is sheathed in a polyurethane envelope 22. A poly jacket 24 then wraps the pipe region where the sensors are located. The strake 24 is then mounted on the exterior of the assembly. This configuration is generally used in new, pre-deployment operation.

In the alternative embodiment, a plurality of sensors Sr will be mounted on the interior surface of the jacket 22 before it is mounted on the riser 20. The jacket and sensor array is then mounted on the riser. The strake is then mounted on the exterior of the assembly in the area of the sensor array.

Figure 3:
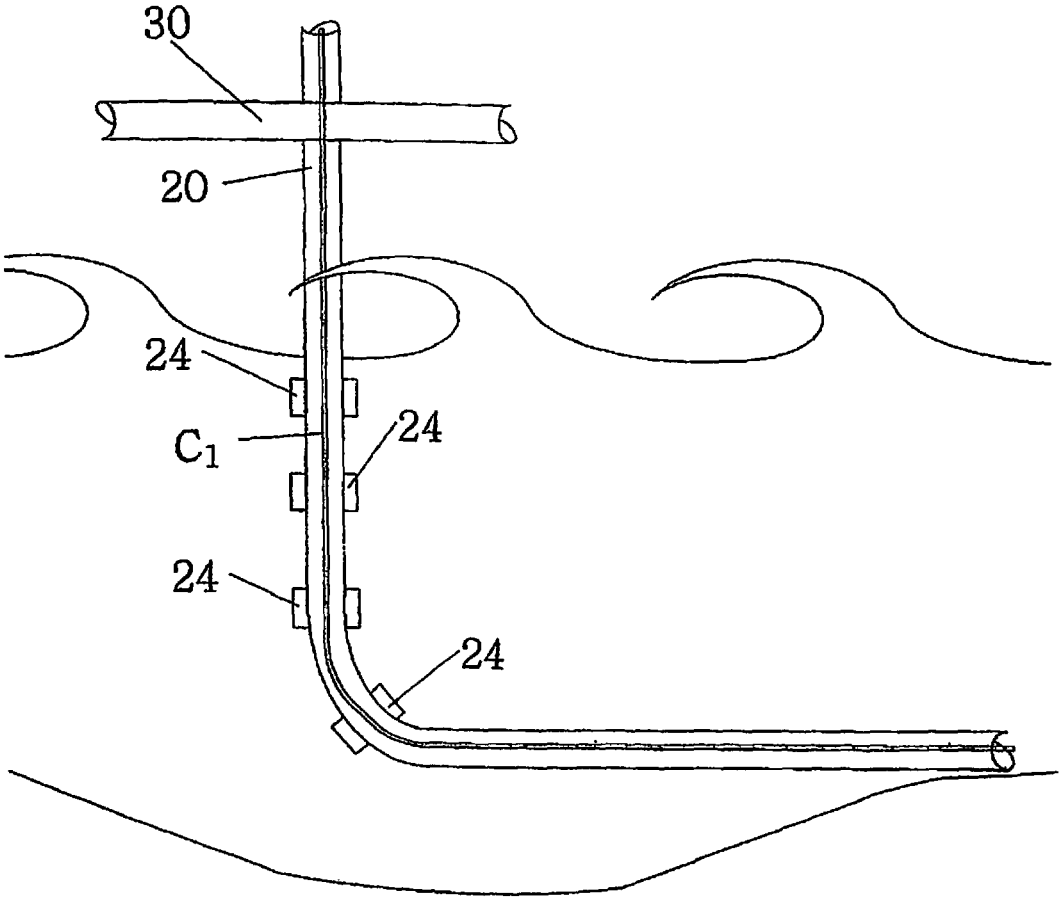
FIG. 3 is a diagrammatic view or a portion of a typical riser having fiber optic sensors in accordance with the subject invention.

FIG. 3 shows a typical riser system incorporating fiber optic sensor system of the subject invention. The riser 20 extends from the rig floor 30 to the sea floor 32. A plurality of strakes 24 will be mounted at selected positions on the riser pipe in typical manner. Sensors Sm and/or SR will mounted on the riser assembly as described, on selected strakes. A fiber optic cable C1-Cn will be associated with a respective sensor for carrying the signal produced at the sensor back to the rig floor 20. The cables C1-Cn are then combined for managing the signals as described.

While certain features and embodiments of the invention have been shown and described in detail herein, it should be understood that the invention encompasses all modifications and enhancements within the scope and spirit of the following claims.

What is claimed is:

1. A vortex induced vibration suppression device for use in combination with a subsea riser system, the suppression device for the riser system comprising:

a. A riser;

b. An element mounted external of and secured to the riser;

c. At least one sensor mounted in the vicinity of the element, the sensor including an output cable for transmission of a sensor signal produced by the sensor, the sensor being adapted for compensating for ambient temperature conditions at the point of the location of the sensor;

d. A processor for receiving the sensor signal, for producing a processed signal; and e. Said at least one fiber optic sensor having a Bragg grating with a reflectivity of greater than 4%.

2. The suppression device of claim 1, wherein the fiber optic sensor is an electrical based sensor.

3. The suppression device of claim 1, wherein the fiber optic sensor has an accelerometer.

* * * * *